US006117527A

United States Patent [19]

Schwarz, Jr.

[11] Patent Number: 6,117,527

[45] **Date of Patent: *Sep. 12, 2000**

[54] RECORDING SHEETS AND INK JET PRINTING PROCESSES THEREWITH

[75] Inventor: William M. Schwarz, Jr., Webster, N.Y.

[73] Assignee: Xerox Corporation, Stamford, Conn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/916,517

[22] Filed: Aug. 22, 1997

[51] Int. Cl.[7] ..... B41M 5/00

[52] U.S. Cl. ..... 428/195; 347/105; 428/411.1

[58] Field of Search ..... 428/195, 411.1; 347/105

[56] References Cited

U.S. PATENT DOCUMENTS

| | | | |
|---|---|---|---|
| 4,082,879 | 4/1978 | Conder et al. | 428/219 |
| 4,400,456 | 8/1983 | Matsuda et al. | 430/138 |
| 5,589,277 | 12/1996 | Malhotra | 428/500 |
| 5,657,064 | 8/1997 | Malhotra | 347/105 |
| 5,672,560 | 9/1997 | Rush | 503/209 |
| 5,683,793 | 11/1997 | Malhotra et al. | 428/216 |

FOREIGN PATENT DOCUMENTS

| | | | |
|---|---|---|---|
| 0 667 245 A1 | 2/1995 | European Pat. Off. . | |
| 0 667 246 A1 | 8/1995 | European Pat. Off. . | |
| 60-230895 | 11/1985 | Japan . | |
| 1-241487 | 9/1989 | Japan | 428/195 |
| 6-270529 | 9/1994 | Japan . | |
| 7-251562 | 10/1995 | Japan . | |
| 8-239622 | 9/1996 | Japan . | |
| 924610 | 6/1992 | Saudi Arabia . | |

OTHER PUBLICATIONS

D. Balasubramanian & Stig E. Friberg, "Hydrotropes—Recent Developments", *Surface and Colloid Science*, vol. 15, E. Matijevic, ed., Plenum Press (New York 1993), p. 197–220.

*Primary Examiner*—Bruce H. Hess
*Attorney, Agent, or Firm*—Judith L. Byorick

[57] ABSTRACT

Disclosed is a recording sheet which comprises a substrate and an image-receiving layer situated on at least one surface of the substrate, said image-receiving layer being suitable for receiving images of an aqueous ink, said image-receiving layer comprising (a) a binder polymer; and (b) an additive selected from the group consisting of (5-carboxy-4-hexyl-2-cyclohexen-1-yl) octanoic acid, (6-carboxy-4-hexyl-2-cyclohexen-1-yl) octanoic acid, saccharin salts, dihexyl sulfosuccinate salts, benzoate salts, monohydroxy-substituted benzoate salts, dihydroxy-substituted benzoate salts, trihydroxy-substituted benzoate salts, benzene sulfonate salts, monohydroxy-substituted benzene sulfonate salts, dihydroxy-substituted benzene sulfonate salts, benzene disulfonate salts, toluene sulfonate salts, bromobenzene sulfonate salts, xylene sulfonate salts, cumene sulfonate salts, cymene sulfonate salts, cinnamate salts, isonicotinate salts, gallate salts, piccolinate salts, hydroxynaphthoate salts, n-butylmonoglycolsulfate salts, 2-ethylhexylsulfate salts, p-aminobenzoic acid acid salts, procaine acid salts, dibucaine acid salts, caffeine, resorcinol, and mixtures thereof.

25 Claims, No Drawings

RECORDING SHEETS AND INK JET PRINTING PROCESSES THEREWITH

BACKGROUND OF THE INVENTION

The present invention is directed to recording sheets particularly suitable for ink jet printing processes. More specifically, the present invention is directed to recording sheets and to ink jet printing processes employing said sheets wherein the sheets enable the generation of high quality images and exhibit reduced or no haze in the image receiving layer thereof. One embodiment of the present invention is directed to a recording sheet which comprises a substrate and an image-receiving layer situated on at least one surface of the substrate, said image-receiving layer being suitable for receiving images of an aqueous ink, said image-receiving layer comprising (a) a binder polymer; and (b) an additive selected from the group consisting of (5-carboxy-4-hexyl-2-cyclohexen-1-yl) octanoic acid, (6-carboxy-4-hexyl-2-cyclohexen-1-yl) octanoic acid, saccharin salts, dihexyl sulfosuccinate salts, benzoate salts, monohydroxy-substituted benzoate salts, dihydroxy-substituted benzoate salts, trihydroxy-substituted benzoate salts, benzene sulfonate salts, monohydroxy-substituted benzene sulfonate salts, dihydroxy-substituted benzene sulfonate salts, benzene disulfonate salts, toluene sulfonate salts, bromobenzene sulfonate salts, xylene sulfonate salts, cumene sulfonate salts, cymene sulfonate salts, cinnamate salts, isonicotinate salts, gallate salts, piccolinate salts, hydroxynaphthoate salts, n-butylmonoglycolsulfate salts, 2-ethylhexylsulfate salts, p-aminobenzoic acid acid salts, procaine acid salts, dibucaine acid salts, caffeine, resorcinol, and mixtures thereof.

Recording sheets suitable for use in ink jet printing are known. For example, U.S. Pat. No. 5,589,277 (Malhotra), the disclosure of which is totally incorporated herein by reference, discloses a recording sheet which comprises a paper substrate and a material selected from the group consisting of monomeric amino acids, monomeric hydroxy acids, monomeric polycarboxyl compounds, and mixtures thereof. Another embodiment of the invention is directed to a recording sheet which comprises a substrate and a material selected from the group consisting of monomeric amino acids, monomeric hydroxy acids, and mixtures thereof.

European Patent Application 0 667 245 A1 (Malhotra), the disclosure of which is totally incorporated herein by reference, discloses a recording sheet which comprises a substrate and a material selected from the group consisting of monosaccharides, oligosaccharides, and mixtures thereof. Another embodiment is directed to a printing process which comprises (a) providing a recording sheet which comprises a substrate, a material selected from the group consisting of monomeric alcohols, monosaccharides, oligosaccharides, and mixtures thereof, an optional binder, an optional antistatic agent, an optional biocide, and an optional filler; (b) applying an aqueous recording liquid to the recording sheet in an imagewise pattern; and (c) thereafter exposing the substrate to microwave radiation, thereby drying the recording liquid on the recording sheet.

South African Patent Application 924,610, the disclosure of which is totally incorporated herein by reference, discloses a transparent recording sheet suitable for making visual transparencies which comprises a thin transparent film backing bearing on at least one major surface thereof an ink jet receptive layer comprising from 1% to 10% of at least one acid having a pKa of from 2 to 6, said acid being selected from the group consisting of aryl monocarboxylic acids, aryloxy monocarboxylic acids, alkyl carboxylic acids having alkyl groups containing at least 11 carbon atoms, dicarboxylic acids, tricarboxylic acids, and pyridinium salts, and at least one liquid-absorbent polymer comprising from 90% to 99% aprotic constituents, wherein said sheet shows reduced fading when imaged with an ink containing triarylmethane dye and at least one nucleophile over an identical composition containing no protic organic-solvent-soluble additive.

Copending application U.S. Ser. No. 08/657,134, filed Jun. 3, 1996, entitled "Ink Jet Transparencies," with the named inventors Shadi L. Malhotra, Kirit N. Naik, David N. MacKinnon, and Arthur Y. Jones, the disclosure of which is totally incorporated herein by reference, discloses a transparency which comprises a supporting substrate, thereover a first coating layer comprising an ink absorbing layer and a biocide, and a second ink spreading coating layer comprising a hydrophilic vinyl binder, a dye mordant, a filler, an optional lightfastness inducing agent, and an ink spot size increasing agent selected from the group consisting of hydroxy acids, amino acids, and polycarboxyl compounds; and wherein the first coating is in contact with the substrate and is situated between the substrate and the second ink coating, and which transparency possesses a haze value of from about 0.5 to about 10 and a lightfastness value of from about 95 to about 98.

D. Balasubramanian and S. E. Friberg, "Hydrotropes—Recent Developments," *Surface and Colloid Science*, vol. 15, E. Matijevic, ed., Plenum Press (New York 1993), p. 197, the disclosure of which is totally incorporated herein by reference, discloses background information, characteristics, and effects of hydrotropes.

While known compositions and processes are suitable for their intended purposes, a need remains for improved recording sheets. In addition, a need remains for recording sheets which are suitable for receiving images of aqueous inks, such as those commonly employed in ink jet printing. Further, a need remains for transparent recording sheets which are suitable for receiving images of aqueous inks and which also exhibit reduced or no haze. Additionally, a need remains for transparent recording sheets which are suitable for receiving images of aqueous inks, which exhibit reduced or no haze, and which enable the generation of high quality images thereon. There is also a need for opaque recording sheets wherein the image receiving coatings thereon exhibit little or no haze, thereby enabling high quality and clarity of color in images generated thereon.

SUMMARY OF THE INVENTION

It is an object of the present invention to provide recording sheets with the above noted advantages.

It is another object of the present invention to provide improved recording sheets.

It is yet another object of the present invention to provide recording sheets which are suitable for receiving images of aqueous inks, such as those commonly employed in ink jet printing.

It is still another object of the present invention to provide transparent recording sheets which are suitable for receiving images of aqueous inks and which also exhibit reduced or no haze.

Another object of the present invention is to provide transparent recording sheets which are suitable for receiving images of aqueous inks, which exhibit reduced or no haze, and which enable the generation of high quality images thereon.

Yet another object of the present invention is to provide opaque recording sheets wherein the image receiving coatings thereon exhibit little or no haze, thereby enabling high quality and clarity of color in images generated thereon.

These and other objects of the present invention (or specific embodiments thereof) can be achieved by providing a recording sheet which comprises a substrate and an image-receiving layer situated on at least one surface of the substrate, said image-receiving layer being suitable for receiving images of an aqueous ink, said image-receiving layer comprising (a) a binder polymer; and (b) an additive selected from the group consisting of (5-carboxy-4-hexyl-2-cyclohexen-1-yl) octanoic acid, (6-carboxy-4-hexyl-2-cyclohexen-1-yl) octanoic acid, saccharin salts, dihexyl sulfosuccinate salts, benzoate salts, monohydroxy-substituted benzoate salts, dihydroxy-substituted benzoate salts, trihydroxy-substituted benzoate salts, benzene sulfonate salts, monohydroxy-substituted benzene sulfonate salts, dihydroxy-substituted benzene sulfonate salts, benzene disulfonate salts, toluene sulfonate salts, bromobenzene sulfonate salts, xylene sulfonate salts, cumene sulfonate salts, cymene sulfonate salts, cinnamate salts, isonicotinate salts, gallate salts, piccolinate salts, hydroxynaphthoate salts, n-butylmonoglycolsulfate salts, 2-ethylhexylsulfate salts, p-aminobenzoic acid acid salts, procaine acid salts, dibucaine acid salts, caffeine, resorcinol, and mixtures thereof.

DETAILED DESCRIPTION OF THE INVENTION

The present invention is directed to a recording sheet comprising a substrate and an image-receiving layer. The substrate can be either transparent or opaque. Any suitable transparent substrate can be employed. Examples include transparent materials, such as polyester, including Mylar™, available from E.I. Du Pont de Nemours & Company, Melinex™, available from Imperial Chemicals, Inc., Celanar™, available from Celanese Corporation, polyethylene naphthalates, such as Kaladex PEN Films, available from Imperial Chemicals, Inc., polycarbonates such as Lexan™, available from General Electric Company, polysulfones, such as those available from Union Carbide Corporation, polyether sulfones, such as those prepared from 4,4'-diphenyl ether, such as Udel™, available from Union Carbide Corporation, those prepared from disulfonyl chloride, such as Victrex™, available from ICI America Incorporated, those prepared from biphenylene, such as Astrel™, available from 3M Company, poly (arylene sulfones), such as those prepared from crosslinked poly (arylene ether ketone sulfones), cellulose triacetate, polyvinylchloride cellophane, polyvinyl fluoride, polyimides, and the like, with polyester such as Mylar™ being preferred in view of its availability and relatively low cost.

The substrate can also be opaque, including opaque plastics, such as Teslin™, available from PPG Industries, and filled polymers, such as Melinex®, available from ICI. Filled plastics can also be employed as the substrate, particularly when it is desired to make a "never-tear paper" recording sheet. Paper is also suitable, including plain papers such as Xerox® 4024, diazo papers, or the like.

In one embodiment of the present invention, the substrate comprises sized blends of hardwood kraft and softwood kraft fibers containing from about 10 to 90 percent by weight soft wood and from about 10 to about 90 percent by weight hardwood. Examples of hardwood include Seagull W dry bleached hardwood kraft, present in one embodiment in an amount of about 70 percent by weight. Examples of softwood include La Tuque dry bleached softwood kraft, present in one embodiment in an amount of about 30 percent by weight. These substrates can also contain fillers and pigments in any effective amounts, typically from about 1 to about 60 percent by weight, such as clay (available from Georgia Kaolin Company, Astro-fil 90 clay, Engelhard Ansilex clay), titanium dioxide (available from Tioxide Company—Anatase grade AHR), calcium silicate CH-427-97-8, XP-974 (J.M. Huber Corporation), and the like. The sized substrates can also contain sizing chemicals in any effective amount, typically from about 0.25 percent to about 25 percent by weight of pulp, such as acidic sizing, including Mon size (available from Monsanto Company), alkaline sizing such as Hercon-76 (available from Hercules Company), Alum (available from Allied Chemicals as Iron free alum), retention aid (available from Allied Colloids as Percol 292), and the like. The preferred internal sizing degree of papers selected for the present invention, including commercially available papers, varies from about 0.4 to about 5,000 seconds, and papers in the sizing range of from about 0.4 to about 300 seconds are more preferred, primarily to decrease costs. Preferably, the selected substrate is porous, and the porosity value of the selected substrate preferably varies from about 100 to about 1,260 milliliters per minute and preferably from about 50 to about 600 milliliters per minute to enhance the effectiveness of the recording sheet in ink jet processes. Preferred basis weights for the substrate are from about 40 to about 400 grams per square meter, although the basis weight can be outside of this range.

Illustrative examples of commercially available internally and externally (surface) sized substrates suitable for the present invention include Diazo papers, offset papers, such as Great Lakes offset, recycled papers, such as Conservatree, office papers, such as Automimeo, Eddy liquid toner paper and copy papers available from companies such as Nekoosa, Champion, Wiggins Teape, Kymmene, Modo, Domtar, Veitsiluoto and Sanyo, and the like, with Xerox® 4024™ papers and sized calcium silicate-clay filled papers being particularly preferred in view of their availability, reliability, and low print through. Pigmented filled plastics, such as Teslin (available from PPG industries), are also preferred as supporting substrates.

The substrate can be of any effective thickness. Typical thicknesses for the substrate are from about 50 to about 500 microns, and preferably from about 100 to about 125 microns, although the thickness can be outside these ranges.

The image-receiving layer comprises a binder polymer and an additive. Examples of suitable binder polymers include hydrophilic polysaccharides and their modifications, such as (1) starch (such as starch SLS-280, available from St. Lawrence starch), (2) cationic starch (such as Cato-72, available from National Starch), (3) hydroxyalkylstarch, wherein alkyl has at least one carbon atom and wherein the number of carbon atoms is such that the material is water soluble, preferably from about 1 to about 20 carbon atoms, and more preferably from about 1 to about 10 carbon atoms, such as methyl, ethyl, propyl, butyl, or the like (such as hydroxypropyl starch (#02382, available from Poly Sciences Inc.) and hydroxyethyl starch (#06733, available from Poly Sciences Inc.)), (4) gelatin (such as Calfskin gelatin #00639, available from Poly Sciences Inc.), (5) alkyl celluloses and aryl celluloses, wherein alkyl has at least one carbon atom and wherein the number of carbon atoms is such that the material is water soluble, preferably from 1 to about 20 carbon atoms, more preferably from 1 to about 10 carbon atoms, and even more preferably from 1 to about 7 carbon atoms, such as methyl, ethyl, propyl, butyl, pentyl, hexyl, benzyl, and the like (such as methyl cellulose (Methocel AM 4, available from Dow Chemical Company), benzyl cellulose, and the like), and wherein aryl has at least 6 carbon atoms and wherein the number of carbon atoms is such that the material is water soluble, preferably from 6 to about 20 carbon atoms, more preferably from 6 to about 10 carbon atoms, and even more preferably about 6 carbon atoms, such as phenyl cellulose, (6) hydroxy alkyl celluloses, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, pentyl, hexyl, benzyl, or the like (such as hydroxyethyl cellulose (Natrosol 250 LR, available from Hercules Chemical Company), and hydroxypropyl cellulose (Klucel Type E, available from Hercules Chemical Company)), (7) alkyl hydroxy alkyl celluloses, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, pentyl, hexyl, benzyl, or the like (such as ethyl hydroxyethyl cellulose (Bermocoll, available from Berol Kem. A.B. Sweden)), (8) hydroxy alkyl alkyl celluloses, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like (such as hydroxyethyl methyl cellulose (HEM, available from British Celanese Ltd., also available as Tylose MH, MHK from Kalle A.G.), hydroxypropyl methyl cellulose (Methocel K35LV, available from Dow Chemical Company), and hydroxy butylmethyl cellulose (such as HBMC, available from Dow Chemical Company)), (9) dihydroxyalkyl cellulose, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like (such as dihydroxypropyl cellulose, which can be prepared by the reaction of 3-chloro-1,2-propane with alkali cellulose), (10) hydroxy alkyl hydroxy alkyl cellulose, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like (such as hydroxypropyl hydroxyethyl cellulose, available from Aqualon Company), (11) halodeoxycellulose, wherein halo represents a halogen atom (such as chlorodeoxycellulose, which can be prepared by the reaction of cellulose with sulfuryl chloride in pyridine at 25° C.), (12) amino deoxycellulose (which can be prepared by the reaction of chlorodeoxy cellulose with 19 percent alcoholic solution of ammonia for 6 hours at 160° C.), (13) dialkylammonium halide hydroxy alkyl cellulose, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, and wherein halide represents a halogen atom (such as diethylammonium chloride hydroxy ethyl cellulose, available as Celquat H-100, L-200, National Starch and Chemical Company), (14) hydroxyalkyl trialkyl ammonium halide hydroxyalkyl cellulose, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, and wherein halide represents a halogen atom (such as hydroxypropyl trimethyl ammonium chloride hydroxyethyl cellulose, available from Union Carbide Company as Polymer JR), (15) dialkyl amino alkyl cellulose, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, (such as diethyl amino ethyl cellulose, available from Poly Sciences Inc. as DEAE cellulose #05178), (16) carboxyalkyl dextrans, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, pentyl, hexyl, and the like, (such as carboxymethyl dextrans, available from Poly Sciences Inc. as #16058), (17) dialkyl aminoalkyl dextran, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like (such as diethyl aminoethyl dextran, available from Poly Sciences Inc. as #5178), (18) amino dextran (available from Molecular Probes Inc.), (19) carboxy alkyl cellulose salts, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, and wherein the cation is any conventional cation, such as sodium, lithium, potassium, calcium, magnesium, or the like (such as sodium carboxymethyl cellulose CMC 7HOF, available from Hercules Chemical Company), (20) gum arabic (such as #G9752, available from Sigma Chemical Company), (21) carrageenan (such as #C1013 available from Sigma Chemical Company), (22) karaya gum (such as #G0503, available from Sigma Chemical Company), (23) xanthan (such as Keltrol-T, available from Kelco division of Merck and Company), (24) chitosan (such as #C3646, available from Sigma Chemical Company), (25) carboxyalkyl hydroxyalkyl guar, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like (such as carboxymethyl hydroxypropyl guar, available from Auqualon Company), (26) cationic guar (such as Celanese Jaguars C-14-S, C-15, C-17, available from Celanese Chemical Company), (27) n-carboxyalkyl chitin, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, such as n-carboxymethyl chitin, (28) dialkyl ammonium hydrolyzed collagen protein, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like (such as dimethyl ammonium hydrolyzed collagen protein, available from Croda as Croquats), (29) agar-agar (such as that available from Pfaltz and Bauer Inc.), (30) cellulose sulfate salts, wherein the cation is any conventional cation, such as sodium, lithium, potassium, calcium, magnesium, or the like (such as sodium cellulose sulfate #023 available from Scientific Polymer Products), and (31) carboxyalkylhydroxyalkyl cellulose salts, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, and wherein the cation is any conventional cation, such as sodium, lithium, potassium, calcium, magnesium, or the like (such as sodium carboxymethylhydroxyethyl cellulose CMHEC 43H and 37L available from Hercules Chemical Company); and the like.

Also suitable are polymers which form latices in water and which are applied to the substrate in the form of a latex, including styrene-butadiene latexes (such as that available from Gen Corp Polymer Products, such as RES 4040 and RES 4100, available from Unocal Chemicals, and such as DL 6672A, DL6638A, and DL6663A, available from Dow Chemical Company), ethylene-vinyl acetate latexes (such as Airflex 400, available from Air Products and Chemicals Inc.), vinyl acetate-acrylic copolymer latexes (such as synthemul 97-726, available from Reichhold Chemical Inc., Resyn 25-1110 and Resyn 25-1140, available from National Starch Company, and RES 3103 available from Unocal Chemicals), quaternary acrylic copolymer latexes, including those of the formula

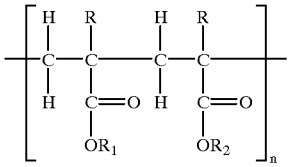

wherein n is a number of from about 10 to about 100, and preferably about 50, R is hydrogen or methyl, $R_1$ is hydrogen, an alkyl group, or an aryl group, and $R_2$ is $(N^+(CH_3)_3)_nX^{n-}$, wherein X is an anion, such as Cl—, Br—, I—, $HSO_3$—, $SO_3^{2}$—, $CH_2SO_3$—, $H_2PO_4$—, $HPO_4^{2}$—, $PO_4^{3}$—, or the like, n is an integer of from 1 to 3, and the degree of quaternization is from about 1 to about 100 percent, including polymers such as polymethyl acrylate trimethyl ammonium chloride latex, including HX42-1 and HX42-3, available from Interpolymer Corp., and the like.

Also suitable are polyethylene oxides and polyethylene oxide derivatives, such as (1) poly(oxyethylene) or poly (ethylene oxide), including POLY OX WSRN-3000 available from Union Carbide Corporation; (2) ethylene oxide/2-hydroxyethyl methacrylate/ethylene oxide and ethylene oxide/hydroxypropyl methacrylate/ethylene oxide triblock copolymers, which can be synthesized via free radical polymerization of hydroxyethyl methacrylate or hydroxypropyl methacrylate with 2-aminoethanethiol using α,α'-azobisisobutyronitrile as initiator, and reacting the resulting amino-semitelechelic oligo-hydroxyethyl methacrylate or amino-hydroxypropyl methacrylate with an isocyanate-polyethylene oxide complex in chlorobenzene at 0° C., and precipitating the reaction mixture in diethylether, filtering and drying in vacuum; (3) ethylene oxide/4-vinyl pyridine/ethylene oxide triblock copolymers, which can be synthesized via anionic polymerization of 4-vinyl pyridine with sodium naphthalene as initiator at −78° C. and then adding ethylene oxide monomer, the reaction being carried out in an explosion proof stainless steel reactor; (4) ionene/ethylene oxide/ionene triblock copolymers, which can be synthesized via quaternization reaction of one end of each 3-3 ionene with the halogenated, preferably brominated, poly (oxyethylene) in methanol at about 40° C.; (5) ethylene oxide/isoprene/ethylene oxide triblock copolymers, which can be synthesized via anionic polymerization of isoprene with sodium naphthalene in tetrahydrofuran as solvent at −78° C., and then adding monomer ethylene oxide and polymerizing the reaction for three days, after which time the reaction is quenched with methanol, the ethylene oxide content in the aforementioned triblock copolymers being from about 20 to about 70 percent by weight and preferably about 50 percent by weight; (6) ethylene oxide/propylene oxide copolymers, including ethylene oxide/propylene oxide/ethylene oxide triblock copolymers, such as Alkatronic EGE-31-1 available from Alkaril Chemicals, propylene oxide/ethylene oxide/propylene oxide triblock copolymers, such as Alkatronic PGP 3B-1 available from Alkaril Chemicals, tetrafunctional block copolymers derived from the sequential addition of ethylene oxide and propylene oxide to ethylene diamine, the content of ethylene oxide in these block copolymers being from about 5 to about 95 percent by weight, such as Tetronic 50R8 available from BASF Corporation; and the like.

Mixtures of any two or more of the above binder polymers can also be employed.

Suitable additives include (5-carboxy-4-hexyl-2-cyclohexen-1-yl) octanoic acid, (6-carboxy-4-hexyl-2-cyclohexen-1-yl) octanoic acid, saccharin salts, such as sodium saccharin, dihexyl sulfosuccinate salts, such as sodium dihexyl sulfosuccinate, benzoate salts, such as sodium benzoate, monohydroxy-substituted benzoate salts, of the general formula

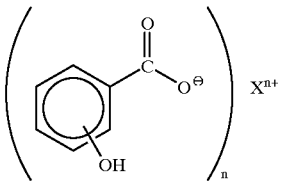

wherein X is a cation, including salicylate salts such as sodium salicylate, dihydroxy-substituted benzoate salts, of the general formula

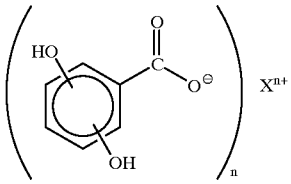

wherein X is a cation, trihydroxy-substituted benzoate salts, of the general formula

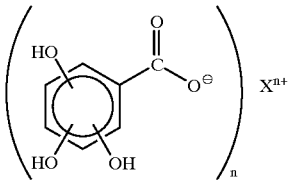

wherein X is a cation, benzene sulfonate salts, such as sodium benzene sulfonate, monohydroxy-substituted benzene sulfonate salts, of the general formula

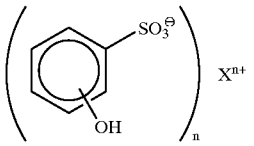

wherein X is a cation, dihydroxy-substituted benzene sulfonate salts, of the general formula

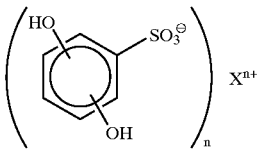

wherein X is a cation, benzene disulfonate salts, such as sodium benzene disulfonate, toluene sulfonate salts, such as sodium p-toluene sulfonate, bromobenzene sulfonate salts, such as sodium p-bromobenzene sulfonate, xylene sulfonate salts, such as sodium xylene sulfonate, cumene sulfonate salts, such as sodium cumene sulfonate, cymene sulfonate salts, such as sodium cymene sulfonate, cinnamate salts, such as sodium cinnamate, isonicotinate salts, such as sodium isonicotinate, gallate salts, such as sodium gallate, piccolinate salts, such as sodium 4-piccolinate, hydroxynaphthoate salts, such as sodium 3-hydroxy-2-naphthoate, n-butylmonoglycolsulfate salts, such as sodium n-butylmonoglycolsulfate, 2-ethylhexylsulfate salts, such as sodium 2-ethylhexylsulfate, p-aminobenzoic acid acid salts, such as p-aminobenzoic acid hydrochloride, procaine acid salts, such as procaine hydrochloride, dibucaine acid salts, such as dibucaine hydrochloride, caffeine, resorcinol, and the like, as well as mixtures thereof. Examples of suitable salts of the above materials also include, for example, potassium salts, lithium salts, ammonium salts, and the like. Examples of suitable acid salts of the above materials also include, for example, acetic acid salts, lactic acid salts, glycolic acid salts, nitric acid salts, and the like.

The binder and the additive are present in relative amounts with respect to each other so as to enable reduction or elimination of haze in the image receiving layer. When the substrate is transparent, haze is thus reduced or eliminated in the entire transparency. Haze is measured as the percentage of light which is prevented from passing through the transparent recording sheet. For example, if a transparency allows 97 percent of the light shining upon it to pass through, the transparency has a haze value of 3. Haze can be measured by any desired or suitable apparatus, such as a XL-211 HAZEGARD hazemeter, available from Pacific Scientific Co., or the like. Transparent recording sheets of the present invention typically have haze values of no more than about 10, preferably no more than about 3, and more preferably no more than about 2, although the haze value can be outside this range. Typically, the binder and the additive are present in relative amounts with respect to each other of from about 5 percent by weight additive and about 95 percent by weight binder to about 33 percent by weight additive and about 67 percent by weight binder. Preferably the additive is present in an amount of at least about 10 percent by weight of the binder/additive mixture.

The coating containing the binder and additive is present on the substrate of the recording sheet of the present invention in any effective thickness. Typically, the total thickness of the coating layer (on each surface, when both sides of the substrate are coated) is from about 1 to about 25 microns and preferably from about 5 to about 10 microns, although the thickness can be outside of these ranges.

If desired, additional layers can be present in the recording sheet, such as layers situated between the substrate and the image-receiving layer, protective overcoatings situated so that the image-receiving layer is between the substrate and the overcoating, antistatic layers, anticurl layers, or the like.

The coating or coatings can be applied to the substrate by any suitable technique. For example, the layer coatings can be applied by a number of known techniques, such as size press treatment, dip coating, reverse roll coating, extrusion coating, or the like. For example, the coating can be applied with a KRK size press (Kumagai Riki Kogyo Co., Ltd., Nerima, Tokyo, Japan) by dip coating and can be applied by solvent extrusion on a Faustel Coater. The KRK size press is a lab size press that simulates a commercial size press. This size press is normally sheet fed, whereas a commercial size press typically employs a continuous web. On the KRK size press, the substrate sheet is taped by one end to the carrier mechanism plate. The speed of the test and the roll pressures are set, and the coating solution is poured into the solution tank. A 4 liter stainless steel beaker is situated underneath for retaining the solution overflow. The coating solution is cycled once through the system (without moving the substrate sheet) to wet the surface of the rolls and then returned to the feed tank, where it is cycled a second time. While the rolls are being "wetted", the sheet is fed through the sizing rolls by pressing the carrier mechanism start button. The coated sheet is then removed from the carrier mechanism plate and is placed on a 12 inch by 40 inch sheet of 750 micron thick Teflon for support and is dried on the Dynamic Former drying drum and held under restraint to prevent shrinkage. The drying temperature is approximately 105° C. This method of coating treats both sides of the substrate simultaneously.

In dip coating, a web of the material to be coated is transported below the surface of the liquid coating composition by a single roll in such a manner that the exposed site is saturated, followed by removal of any excess coating by the squeeze rolls and drying at 100° C. in an air dryer. The liquid coating composition generally comprises the desired coating composition dissolved in a solvent such as water, methanol, or the like. The method of surface treating the substrate using a coater results in a continuous sheet of substrate with the coating material applied first to one side and then to the second side of this substrate. The substrate can also be coated by a slot extrusion process, wherein a flat die is situated with the die lips in close proximity to the web of substrate to be coated, resulting in a continuous film of the coating solution evenly distributed across one surface of the sheet, followed by drying in an air dryer at 100° C.

Recording sheets of the present invention can be employed in ink jet printing processes. One embodiment of the present invention is directed to a process which comprises applying an aqueous recording liquid to a recording sheet of the present invention in an imagewise pattern. Another embodiment of the present invention is directed to a printing process which comprises (1) incorporating into an ink jet printing apparatus containing an aqueous ink a recording sheet of the present invention, and (2) causing droplets of the ink to be ejected in an imagewise pattern onto the recording sheet, thereby generating images on the recording sheet. Ink jet printing processes are well known, and are described in, for example, U.S. Pat. No. 4,601,777, U.S. Pat. No. 4,251,824, U.S. Pat. No. 4,410,899, U.S. Pat. No. 4,412,224, and U.S. Pat. No. 4,532,530, the disclosures of each of which are totally incorporated herein by reference. In a particularly preferred embodiment, the printing apparatus employs a thermal ink jet process wherein the ink in the nobles is selectively heated in an imagewise pattern, thereby causing droplets of the ink to be ejected in imagewise pattern.

The recording sheets of the present invention can also be used in any other printing or imaging process, such as printing with pen plotters, handwriting with ink pens, offset printing processes, or the like, provided that the ink employed to form the image is compatible with the ink receiving layer of the recording sheet.

Specific embodiments of the invention will now be described in detail. These examples are intended to be illustrative, and the invention is not limited to the materials, conditions, or process parameters set forth in these embodiments. All parts and percentages are by weight unless otherwise indicated.

EXAMPLE I

Transparency sheets are prepared as follows. Blends of 70 percent by weight hydroxypropyl methyl cellulose (HPMC) K35LV (Dow Chemical) and 30 percent by weight of various additive compositions are prepared by mixing 56 grams of hydroxypropyl methyl cellulose and 24 grams of the additive composition in 1,000 milliliters of water in a 2 Liter jar and stirring the contents in an Omni homogenizer for 2 hours. Subsequently, the solution is left overnight for removal of air bubbles. The blends thus prepared are then coated by a dip coating process (both sides coated in one operation) by providing Mylar® base sheets in cut sheet form (8.5×1 inches) in a thickness of 100 microns. Subsequent to air drying at 25° C. for 3 hours followed by oven drying at 100° C. for 10 minutes and monitoring the difference in weight prior to and subsequent to coating, the dried coated sheets are each coated with 1 gram, 10 microns in thickness, on each surface (2 grams total coating weight for 2-sided transparency) of the substrate. Additive compositions employed are as follows:

| Additive |
|---|
| (5-carboxy-4-hexyl-2-cyclohexen-1-yl) octanoic acid |
| (6-carboxy-4-hexyl-2-cyclohexen-1-yl) octanoic acid |
| sodium saccharin |
| sodium dihexyl sulfosuccinate |
| sodium benzoate |
| sodium salicylate |
| sodium benzene sulfonate |
| sodium benzene disulfonate |
| sodium p-toluene sulfonate |
| sodium p-bromobenzene sulfonate |
| sodium xylene sulfonate |

-continued

| Additive |
|---|
| sodium cumene sulfonate |
| sodium cymene sulfonate |
| sodium cinnamate |
| sodium isonicotinate |
| sodium gallate |
| sodium 4-piccolinate |
| sodium 3-hydroxy-2-naphthoate |
| sodium n-butylmonoglycolsulfate |
| sodium 2-ethylhexylsulfate |
| p-aminobenzoic acid hydrochloride |
| procaine hydrochloride |
| dibucaine hydrochloride |
| caffeine |
| resorcinol |

The transparency sheets thus prepared were incorporated into a Hewlett-Packard 500-C color ink jet printer containing inks of the following compositions:

Cyan: 20 percent by weight ethylene glycol, 2.5 percent by weight benzyl alcohol, 1.9 percent by weight ammonium chloride, 0.1 percent by weight Dowicil 150 biocide, 0.05 percent by weight polyethylene oxide (molecular weight 18,500), 30 percent by weight Projet Cyan 1 dye, 45.45 percent by weight water.

Magenta: 20 percent by weight ethylene glycol, 2.5 percent by weight benzyl alcohol, 1.9 percent by weight ammonium chloride, 0.1 percent by weight Dowicil 150 biocide, 0.05 percent by weight polyethylene oxide (molecular weight 18,500), 2.5 percent by weight Triton Direct Red 227 dye, 72.95 percent by weight water.

Yellow: 20 percent by weight ethylene glycol, 2.5 percent by weight benzyl alcohol, 1.9 percent by weight ammonium chloride, 0.1 percent by weight Dowicil 150 biocide, 0.05 percent by weight polyethylene oxide (molecular weight 18,500), 3 percent by weight Hoechst Duasyn Brilliant Yellow SF-GL VP220 dye, 72.45 percent by weight water.

Images are generated by printing block patterns for magenta, cyan, yellow, and black. The black images are "process black" (i.e., formed by superimposition of cyan, magenta, and yellow images). It is believed that the images thus formed will exhibit good color, optical density, dry times, and edge characteristics. It is also believed that the transparencies, both before and after imaging, will exhibit good haze values of no more than about 10, and, in most instances, of no more than about 3.

The above process is repeated with the exception that the coating composition contains 5 percent by weight additive and 95 percent by weight additive. It is believed that similar results will be obtained.

The above process is repeated with the exception that the coating composition contains 10 percent by weight additive and 90 percent by weight additive. It is believed that similar results will be obtained.

The above process is repeated with the exception that the coating composition contains 20 percent by weight additive and 80 percent by weight additive. It is believed that similar results will be obtained.

EXAMPLE II

The process described in Example I is repeated with the exception that the binder polymer is sodium carboxymethyl cellulose (CMC 7HOF, Hercules Chemicals). It is believed that similar results will be obtained.

EXAMPLE III

The process described in Example I is repeated with the exception that the binder polymer is a mixture of hydroxypropyl methyl cellulose (HPMC) K35LV (Dow Chemical) (75 percent by weight) and polyethylene oxide (POLY OX WSRN-3000, Union Carbide) (25 percent by weight). It is believed that similar results will be obtained.

EXAMPLE IV

The process described in Example I is repeated with the exception that the binder polymer is a mixture of sodium carboxymethyl cellulose (CMC 7HOF, Hercules Chemicals) (60 percent by weight) and polyethylene oxide (POLY OX WSRN-3000, Union Carbide) (40 percent by weight). It is believed that similar results will be obtained.

EXAMPLE V

The process described in Example I is repeated with the exception that the binder polymer is a mixture of hydroxypropyl methyl cellulose (HPMC) K35LV (Dow Chemical) (50 percent by weight), sodium carboxymethyl cellulose (CMC 7HOF, Hercules Chemicals) (25 percent by weight) and polyethylene oxide (POLY OX WSRN-3000, Union Carbide) (25 percent by weight). It is believed that similar results will be obtained.

EXAMPLE VI

The processes described in Examples I through V are repeated with the exception that the substrate is Xerox 10 Series Smooth paper and that the image receiving layer is applied with a #7 Mayer rod, resulting in a coating about 11 microns thick. It is believed that the images thus formed will exhibit good color, optical density, dry times, and edge characteristics.

Other embodiments and modifications of the present invention may occur to those of ordinary skill in the art subsequent to a review of the information presented herein; these embodiments and modifications, as well as equivalents thereof, are also included within the scope of this invention.

What is claimed is:

1. A recording sheet which comprises a substrate and an image-receiving coating situated on at least one surface of the substrate, said image-receiving coating being suitable for receiving images of an aqueous ink, said image-receiving coating comprising (a) a binder polymer; and (b) an additive selected from the group consisting of (5-carboxy-4-hexyl-2-cyclohexen-1-yl) octanoic acid, (6-carboxy-4-hexyl-2-cyclohexen-1-yl) octanoic acid, saccharin salts, dihexyl sulfosuccinate salts, benzoate salts, monohydroxy-substituted benzoate salts, dihydroxy-substituted benzoate salts, trihydroxy-substituted benzoate salts, benzene sulfonate salts, monohydroxy-substituted benzene sulfonate salts, dihydroxy-substituted benzene sulfonate salts, benzene disulfonate salts, toluene sulfonate salts, bromobenzene sulfonate salts, xylene sulfonate salts, cumene sulfonate salts, cymene sulfonate salts, cinnamate salts, isonicotinate salts, piccolinate salts, hydroxynaphthoate salts, n-butylmonoglycolsulfate salts, 2-ethylhexylsulfate salts, p-aminobenzoic acid acid salts, procaine acid salts, and mixtures thereof.

2. A recording sheet according to claim 1 wherein the substrate is opaque.

3. A recording sheet according to claim 1 wherein the substrate is transparent.

4. A recording sheet according to claim 3 wherein said recording sheet has a haze value of no more than about 10.

5. A recording sheet according to claim 3 wherein said recording sheet has a haze value of no more than about 3.

6. A recording sheet according to claim 3 wherein said reording sheet has a haze value of no more than about 2.

7. A recording sheet according to claim 1 wherein the binder polymer and the additive are present in the image-receiving coating in relative amounts with respect to each other of from about 5 percent by weight additive and about 95 percent by weight binder polymer to about 33 percent by weight additive and about 67 percent by weight binder polymer.

8. A recording sheet according to claim 1 wherein the image-receiving coating contains the additive in an amount of at least about 10 percent by weight and contains the binder polymer in an amount of no more than about 90 percent by weight.

9. A recording sheet which comprises a substrate and an image-receiving coating situated on at least one surface of the substrate, said image-receiving coating being suitable for receiving images of an aqueous ink, said image-receiving coating comprising (a) a binder polymer; and (b) an additive selected from the group consisting of (5-carboxy-4-hexyl-2-cyclohexen-1-yl) octanoic acid, (6-carboxy-4-hexyl-2-cyclohexen-1-yl) octanoic acid, saccharin salts, dihexyl sulfosuccinate salts, benzoate salts, monohydroxy-substituted benzoate salts, dihydroxy-substituted benzoate salts, trihydroxy-substituted benzoate salts, benzene sulfonate salts, monohydroxy-substituted benzene sulfonate salts, dihydroxy-substituted benzene sulfonate salts, benzene disulfonate salts, toluene sulfonate salts, bromobenzene sulfonate salts, xylene sulfonate salts, cumene sulfonate salts, cymene sulfonate salts, cinnamate salts, isonicotinate salts, piccolinate salts, hydroxynaphthoate salts, n-butylmonoglycolsulfate salts, 2-ethylhexylsulfate salts, p-aminobenzoic acid acid salts, procaine acid salts, resorcinol, and mixtures thereof, wherein the binder polymer is selected from the group consisting of starch; cationic starch; hydroxyalkylstarch, wherein alkyl has at least one carbon atom and wherein the number of carbon atoms in alkyl is such that the material is water soluble; gelatin; alkyl celluloses, wherein alkyl has at least 1 carbon atom and wherein the number of carbon atoms in alkyl is such that the material is water soluble; aryl celluloses, wherein aryl has at least 6 carbon atoms and wherein the number of carbon atoms in aryl is such that the material is water soluble; hydroxy alkyl celluloses, wherein alkyl has at least one carbon atom and wherein the number of carbon atoms in alkyl is such that the material is water soluble; alkyl hydroxy alkyl celluloses, wherein each alkyl has at least one carbon atom and wherein the number of carbon atoms in each alkyl is such that the material is water soluble; hydroxy alkyl alkyl celluloses, wherein each alkyl has at least one carbon atom and wherein the number of carbon atoms in each alkyl is such that the material is water soluble; dihydroxyalkyl cellulose, wherein alkyl has at least one carbon atom and wherein the number of carbon atoms in alkyl is such that the material is water soluble; hydroxy alkyl hydroxy alkyl cellulose, wherein each alkyl has at least one carbon atom and wherein the number of carbon atoms in each alkyl is such that the material is water soluble; halodeoxycellulose, wherein halo represents a halogen atom; amino deoxycellulose; dialkylammonium halide hydroxy alkyl cellulose, wherein each alkyl has at least one carbon atom and wherein the number of carbon atoms in alkyl is such that the material is water soluble, and wherein halide represents a halogen atom; hydroxyalkyl trialkyl ammonium halide hydroxyalkyl cellulose, wherein each alkyl has at least one carbon atom and wherein the number of carbon atoms in each alkyl is such that the material is water soluble, and wherein halide represents a halogen atom; dialkyl amino alkyl cellulose, wherein each alkyl has at least one carbon atom and wherein the number of carbon atoms in each alkyl is such that the material is water soluble; carboxyalkyl dextrans, wherein alkyl has at least one carbon atom and wherein the number of carbon atoms in alkyl is such that the material is water soluble; dialkyl aminoalkyl dextran, wherein each alkyl has at least one carbon atom and wherein the number of carbon atoms in each alkyl is such that the material is water soluble; amino dextran; carboxy alkyl cellulose salts, wherein alkyl has at least one carbon atom and wherein the number of carbon atoms in alkyl is such that the material is water soluble; gum arabic; carrageenan; karaya gum; xanthan; chitosan; carboxyalkyl hydroxyalkyl guar, wherein each alkyl has at least one carbon atom and wherein the number of carbon atoms in each alkyl is such that the material is water soluble; cationic guar; n-carboxyalkyl chitin, wherein alkyl has at least one carbon atom and wherein the number of carbon atoms in alkyl is such that the material is water soluble; dialkyl ammonium hydrolyzed collagen protein, wherein each alkyl has at least one carbon atom and wherein the number of carbon atoms in each alkyl is such that the material is water soluble; agar—agar; cellulose sulfate salts; carboxyalkylhydroxyalkyl cellulose salts, wherein each alkyl has at least one carbon atom and wherein the number of carbon atoms in each alkyl is such that the material is water soluble; styrene-butadiene latexes; ethylene-vinyl acetate latexes; vinyl acetate-acrylic copolymer latexes; quaternary acrylic copolymer latexes; poly(ethylene oxide); ethylene oxide/2-hydroxyethyl methacrylate/ethylene oxide triblock copolymers; ethylene oxide/hydroxypropyl methacrylate/ethylene oxide triblock copolymers; ethylene oxide/4-vinyl pyridine/ethylene oxide triblock copolymers; ionene/ethylene oxide/ionene triblock copolymers; ethylene oxide/isoprene/ethylene oxide triblock copolymers; ethylene oxide/propylene oxide copolymers; and mixtures thereof.

10. A recording sheet according to claim 1 wherein the additive is selected from the group consisting of sodium saccharin, sodium dihexyl sulfosuccinate, sodium benzoate, sodium salicylate, sodium benzene sulfonate, sodium benzene disulfonate, sodium p-toluene sulfonate, sodium p-bromobenzene sulfonate, sodium xylene sulfonate, sodium cumene sulfonate, sodium cymene sulfonate, sodium cinnamate, sodium isonicotinate, sodium 4-piccolinate, sodium 3-hydroxy-2-naphthoate, sodium n-butylmonoglycolsulfate, sodium 2-ethylhexylsulfate, p-aminobenzoic acid hydrochloride, procaine hydrochloride, and mixtures thereof.

11. An imaged recording sheet which comprises a recording sheet comprising a substrate and an image-receiving coating situated on at least one surface of the substrate, said image-receiving coating being suitable for receiving images of an aqueous ink, said image-receiving coating comprising (a) a binder polymer; and (b) an additive selected from the group consisting of (5-carboxy-4-hexyl-2-cyclohexen-1-yl) octanoic acid, (6-carboxy-4-hexyl-2-cyclohexen-1 -yl) octanoic acid, saccharin salts, dihexyl sulfosuccinate salts, benzoate salts, monohydroxy-substituted benzoate salts, dihydroxy-substituted benzoate salts, trihydroxy-substituted benzoate salts, benzene sulfonate salts, monohydroxy-substituted benzene sulfonate salts, dihydroxy-substituted benzene sulfonate salts, benzene disulfonate salts, toluene sulfonate salts, bromobenzene sulfonate salts, xylene sulfonate salts, cumene sulfonate salts, cymene sulfonate salts, cinnamate salts, isonicotinate salts, gallate salts, piccolinate salts, hydroxynaphthoate salts, n-butylmonoglycolsulfate salts, 2-ethylhexylsulfate salts, p-aminobenzoic acid acid salts, procaine acid salts, caffeine, and mixtures thereof, wherein said image receiving coating contains an image applied from an aqueous ink.

12. An imaged recording sheet according to claim 11 wherein the substrate is transparent and said recording sheet has a haze value of no more than about 10.

13. An imaged recording sheet according to claim 11 wherein the substrate is transparent and said recording sheet has a haze value of no more than about 3.

14. An imaged recording sheet according to claim 11 wherein the substrate is transparent and said recording sheet has a haze value of no more than about 2.

15. An imaged recording sheet according to claim 11 wherein the additive is selected from the group consisting of sodium saccharin, sodium dihexyl sulfosuccinate, sodium benzoate, sodium salicylate, sodium benzene sulfonate, sodium benzene disulfonate, sodium p-toluene sulfonate, sodium p-bromobenzene sulfonate, sodium xylene sulfonate, sodium cumene sulfonate, sodium cymene sulfonate, sodium cinnamate, sodium isonicotinate, sodium gallate, sodium 4-piccolinate, sodium 3-hydroxy-2-naphthoate, sodium n-butylmonoglycolsulfate, sodium 2-ethylhexylsulfate, p-aminobenzoic acid hydrochloride, procaine hydrochloride, and mixtures thereof.

16. A process which comprises applying an aqueous recording liquid in an imagewise pattern to a recording sheet which comprises a substrate and an image-receiving coating situated on at least one surface of the substrate, said image-receiving coating comprising (a) a binder polymer; and (b) an additive selected from the group consisting of (5-carboxy-4-hexyl-2-cyclohexen-1-yl) octanoic acid, (6-carboxy-4-hexyl-2-cyclohexen-1-yl) octanoic acid, saccharin salts, dihexyl sulfosuccinate salts, benzoate salts, monohydroxy-substituted benzoate salts, dihydroxy-substituted benzoate salts, trihydroxy-substituted benzoate salts, benzene sulfonate salts, monohydroxy-substituted benzene sulfonate salts, dihydroxy-substituted benzene sulfonate salts, benzene disulfonate salts, toluene sulfonate salts, bromobenzene sulfonate salts, xylene sulfonate salts, cumene sulfonate salts, cymene sulfonate salts, cinnamate salts, isonicotinate salts, gallate salts, piccolinate salts, hydroxynaphthoate salts, n-butylmonoglycolsulfate salts, 2-ethylhexylsulfate salts, p-aminobenzoic acid acid salts, procaine acid salts, caffeine, and mixtures thereof, said image receiving coating being suitable for receiving images of an aqueous ink.

17. A process according to claim 16 wherein the substrate is transparent and said recording sheet has a haze value of no more than about 10.

18. A process according to claim 16 wherein the substrate is transparent and said recording sheet has a haze value of no more than about 3.

19. A process according to claim 16 wherein the substrate is transparent and said recording sheet has a haze value of no more than about 2.

20. A process according to claim 16 wherein the additive is selected from the group consisting of sodium saccharin, sodium dihexyl sulfosuccinate, sodium benzoate, sodium salicylate, sodium benzene sulfonate, sodium benzene disulfonate, sodium p-toluene sulfonate, sodium p-bromobenzene sulfonate, sodium xylene sulfonate, sodium cumene sulfonate, sodium cymene sulfonate, sodium cinnamate, sodium isonicotinate, sodium gallate, sodium 4-piccolinate, sodium 3-hydroxy-2-naphthoate, sodium n-butylmonoglycolsulfate, sodium 2-ethylhexylsulfate, p-aminobenzoic acid hydrochloride, procaine hydrochloride, and mixtures thereof.

21. A printing process which comprises (1) incorporating into an ink jet printing apparatus containing an aqueous ink a recording sheet which comprises a substrate and an image-receiving coating situated on at least one surface of the substrate, said image-receiving coating comprising (a) a binder polymer; and (b) an additive selected from the group consisting of (5-carboxy-4-hexyl-2-cyclohexen-1 -yl) octanoic acid, (6-carboxy-4-hexyl-2-cyclohexen-1-yl) octanoic acid, saccharin salts, dihexyl sulfosuccinate salts, benzoate salts, monohydroxy-substituted benzoate salts, dihydroxy-substituted benzoate salts, trihydroxy-substituted benzoate salts, benzene sulfonate salts, monohydroxy-substituted benzene sulfonate salts, dihydroxy-substituted benzene sulfonate salts, benzene disulfonate salts, toluene sulfonate salts, bromobenzene sulfonate salts, xylene sulfonate salts, cumene sulfonate salts, cymene sulfonate salts, cinnamate salts, isonicotinate salts, gallate salts, piccolinate salts, hydroxynaphthoate salts, n-butylmonoglycolsulfate salts, 2-ethylhexylsulfate salts, p-aminobenzoic acid acid salts, procaine acid salts, caffeine, and mixtures thereof, said image-receiving coating being suitable for receiving images of an aqueous ink, and (2) causing droplets of the ink to be ejected in an imagewise pattern onto the recording sheet, thereby generating images on the recording sheet.

22. A printing process according to claim 21 wherein the substrate is transparent and said recording sheet has a haze value of no more than about 10.

23. A printing process according to claim 21 wherein the substrate is transparent and said recording sheet has a haze value of no more than about 3.

24. A printing process according to claim 21 wherein the substrate is transparent and said recording sheet has a haze value of no more than about 2.

25. A printing process according to claim 21 wherein the additive is selected from the group consisting of sodium saccharin, sodium dihexyl sulfosuccinate, sodium benzoate, sodium salicylate, sodium benzene sulfonate, sodium benzene disulfonate, sodium p-toluene sulfonate, sodium p-bromobenzene sulfonate, sodium xylene sulfonate, sodium cumene sulfonate, sodium cymene sulfonate, sodium cinnamate, sodium isonicotinate, sodium gallate, sodium 4-piccolinate, sodium 3-hydroxy-2-naphthoate, sodium n-butylmonoglycolsulfate, sodium 2-ethylhexylsulfate, p-aminobenzoic acid hydrochloride, procaine hydrochloride, and mixtures thereof.

* * * * *